US006875116B2

(12) United States Patent
Tessier

(10) Patent No.: US 6,875,116 B2
(45) Date of Patent: Apr. 5, 2005

(54) RECREATIONAL RAMP FOR WHEELED VEHICLES AND PROCESS FOR MANUFACTURING SAME

(75) Inventor: Richard Tessier, Nicolet (CA)

(73) Assignee: Tessier Recreo-Parc Inc., Nicolet (CA)

( * ) Notice: Subject to any disclaimer, the term of this patent is extended or adjusted under 35 U.S.C. 154(b) by 0 days.

(21) Appl. No.: 10/183,571

(22) Filed: Jun. 28, 2002

(65) Prior Publication Data

US 2004/0002393 A1 Jan. 1, 2004

(51) Int. Cl.[7] ..... A63C 19/10
(52) U.S. Cl. ..... 472/89; 14/69.5
(58) Field of Search ..... 472/88–90; 14/69.5, 14/71.3; 404/34, 35, 43, 44, 45, 1

(56) References Cited

U.S. PATENT DOCUMENTS

| | | | | | |
|---|---|---|---|---|---|
| 4,569,500 | A | * | 2/1986 | Beede | 249/123 |
| 4,963,055 | A | * | 10/1990 | Sims, Jr. | 404/41 |
| 5,524,310 | A | | 6/1996 | Farnen | |
| 5,870,788 | A | * | 2/1999 | Witkin | 14/69.5 |
| 6,042,480 | A | | 3/2000 | Labelson | |
| 6,176,049 | B1 | * | 1/2001 | Crant et al. | 52/188 |
| 6,309,457 | B1 | | 10/2001 | Guerinet et al. | |

FOREIGN PATENT DOCUMENTS

| | | | |
|---|---|---|---|
| GB | 1 566 186 | * | 4/1980 |
| WO | WO 00/04967 | | 2/2000 |

OTHER PUBLICATIONS

Rhino High Quality Ramps. Datasheet [online; retrieved on Apr. 19, 2002] Retrieved from the Internet:<URL:www.armadillorecreation.com/WhyRihno.htm>.

Rhino Skateramps & Rails. Datasheet [online; retrieved on Apr. 19, 2002] Retrieved from the Internet:<URL:www.rhino–ramps.com/NewFiles/OurMaterials.html>.

Rhino Top, Integrate H.P.L. Datasheet [online; retrieved on Apr. 19, 2002]. Retrieved from the Internet: URL<www.rhino–ramps.com/NewFiles/OurMaterials.htm>.

(Continued)

*Primary Examiner*—K. T. Nguyen

(57) ABSTRACT

A recreational ramp suitable for use with wheeled vehicles, including a support structure and a molded concrete layer mounted on the support structure. The layer includes a sloping region that extends from a ground level to an above-ground level. Also, a process for the fabrication of a molded concrete layer for such a recreational ramp. The process includes preparing a mold from complementary parts, closing the parts onto one another, thus defining an interior space representative of a concrete layer, pouring concrete mixture into the mold; allowing the concrete to settle and separating the complementary parts of the mold to expose the molded concrete layer. Embodiments of the invention offer the advantages of conventional concrete, i.e., a smooth, quiet and durable surface for riding, while the ramp as a whole remains lightweight and less bulky as compared with conventional concrete ramps. A particularly advantageous embodiment uses self-leveling concrete.

26 Claims, 3 Drawing Sheets

OTHER PUBLICATIONS

Skatelite RampSurface. Datasheet [online;retrieved on Apr. 19, 2002]. Retrieved from the Internet: URL<www.skatelite.com/skatelineindex.asp>.

Richlite, [online], Rainier Richlite Co [retrieved on Apr. 19, 2002]. Retrieved from the Internet: URL<www.richlite.com>.

International Symposium on Self–Compacting Concrete SCC–2001, Oct. 23–25, 2001, [online], [retrieved on Apr. 22, 2002]. Retrieved from the Internet (Website of the Koichi University of Technology): URL<www.infra.kochi–tech.ac.jp/sccnet/scc2/>.

Field Performance of Self Leveling Concrete for Reinforced Concrete Bridges. King Industrial Products, [online], [retrieved on Apr. 22, 2002]. Retrieved from the Internet: URL<industrial.kpmindustries.com/projects/self_leveling_concrete.html>.

Concrete Floors, [online], [retrieved on Apr. 22, 2002]. Retrieved from the Internet: URL<www.readersdigest.ca/homegarden/basement05.html>.

Agilia self–placing, self–levelling concrete range, product offer [online], [retrieved on Apr. 22, 2002]. Retrieved from the Internet: URL www.lafarge.com/lafarge/lafargeV2.nsf/html/USInnovation 11.

LaFarge's Environmental Policy, [online], LaFarge, 2002 [retrieved on Apr. 22, 2002]. Retrieved from the Internet: URL <www.lafarge.com/lafarge/lafargeV2.nsf/html/USCodeA6Y11? opendocument&count=500.

Ambroise, Jean, S. Rols and J. Pera *Properties of Self–Levelling Concrete Reinforced by Steel Fibres*, IBRACON 2001, Unit´´de Recherche de Génie Civil–Matériaux; Institut National des Sciences Appliquées de Lyon, France.

* cited by examiner

RECREATIONAL RAMP FOR WHEELED VEHICLES AND PROCESS FOR MANUFACTURING SAME

FIELD OF THE INVENTION

The present invention relates generally to recreational ramps and, more particularly, to recreational ramps for use with wheeled vehicles such as skateboards and the like.

BACKGROUND OF THE INVENTION

Skateboard ramps provide an ideal way for allowing skateboarding enthusiasts to practice their sport away from the hazards of traffic. Such ramps are typically installed by municipalities in skate parks, which are usually located in residential areas. To ensure maximum usage of these parks by skateboarding enthusiasts, the skateboard ramps must provide a smooth ride. At the same time, by virtue of the fact that skateboard ramps are outdoor installations, these must be made resistant to severe changes in the weather, particularly as occur in northern latitudes. In addition, municipalities must be conscious of the effects of noise pollution on nearby residences and hence the surface of the ramp must be designed with a quiet ride in mind.

It is therefore not surprising that skateboard ramps have undergone a considerable evolution from a time when the ride surface was made of wood. Such wooden ramps, although simple to construct and capable of providing riders with a pleasant "feel", require a high degree of maintenance as they tend to decay rather quickly, especially in areas where rain or snow are prevalent. Moreover, as they perish, wooden ramps subject skaters to the risk of injury from splinters and exposed screw heads.

By moving from a wooden ramp to one made of painted steel, one reduces the maintenance requirements of the ramp and thus significantly increases its safety and durability, although rust now becomes a significant impediment to the commercial success of this type of ramp. This is especially problematic in humid climates or in the presence of salt used to melt snow in some regions. Moreover, the rolling of wheels on a steel surface causes a much greater amount of noise than on a wooden ramp. Thus, even with the advent of the stainless or galvanized steel ramp, noise remains a critical issue, along with the added cost of treating the large amounts of metal necessary to create stainless steel skateboard ramps.

Another material that has been used in the construction of skateboard ramps is aluminum. Such a ramp offers the advantage of being more durable than one made of stainless steel. However, aluminum is afflicted by an even greater cost than stainless steel and retains the poor noise performance usually associated with metal surfaces. As a result, aluminum is often not the choice of a cash-strapped municipality in search of skateboard ramps to populate a skate park.

Thus, in search of the ideal skateboarding surface, manufacturers of skateboard ramps have turned to concrete. A concrete surface provides quiet, long-lasting skating pleasure with a superior ride "feel". However, as can be readily imagined, the extreme weight of a concrete structure of the size necessary to provide appropriate elevations and radii of curvature is the most serious drawback of this type of ramp. In particular, the weight of such a structure renders it virtually impossible to account for shifts in the level of the earth that may occur after the ramp is placed, not to mention the disadvantage of requiring special heavy equipment to position the structure in the first place. Moreover, a conventional concrete structure is typically unattractive, not only because of its natural discoloration and liability to graffiti, but also because it curtails the field of view of individuals in its vicinity.

Against this background, it is apparent that the need exists for a skateboard ramp that is capable of providing the durability, safety, noise absorption and "feel" of a conventional concrete ramp, while benefiting from a greatly reduced weight and reduced physical volume.

SUMMARY OF THE INVENTION

The present invention recognizes that the durability, safety, noise absorption and "feel" of the surface provided by a skateboard ramp need not be compromised by excessive weight and/or expense. Accordingly, the present invention may be broadly summarized as providing a recreational ramp suitable for use with wheeled vehicles, including a support structure and a molded concrete layer mounted on the support structure. The molded concrete layer includes a sloping region that extends from a ground level to an above-ground level.

The present invention may also be broadly summarized as a process for the fabrication of a molded concrete layer for use in construction of a recreational ramp suitable for use with wheeled vehicles. The process includes preparing a mold from complementary parts, closing the parts onto one another, thus defining an interior space representative of a concrete layer, pouring concrete mixture into the mold, allowing the concrete to settle and separating the complementary parts of the mold to expose the molded concrete layer. The concrete layer is then mounted onto a support structure.

Embodiments of the invention offer the advantages of conventional concrete, i.e., a smooth, quiet and durable surface for riding, while the ramp as a whole is lighter and less bulky than a conventional concrete ramp. A particularly advantageous embodiment is one in which the concrete is self-leveling concrete, allowing the production of a thin, yet strong molded concrete layer.

These and other aspects and features of the present invention will now become apparent to those of ordinary skill in the art upon review of the following description of specific embodiments of the invention in conjunction with the accompanying drawings.

DETAILED DESCRIPTION OF THE PREFERRED EMBODIMENTS

Figure 1A:
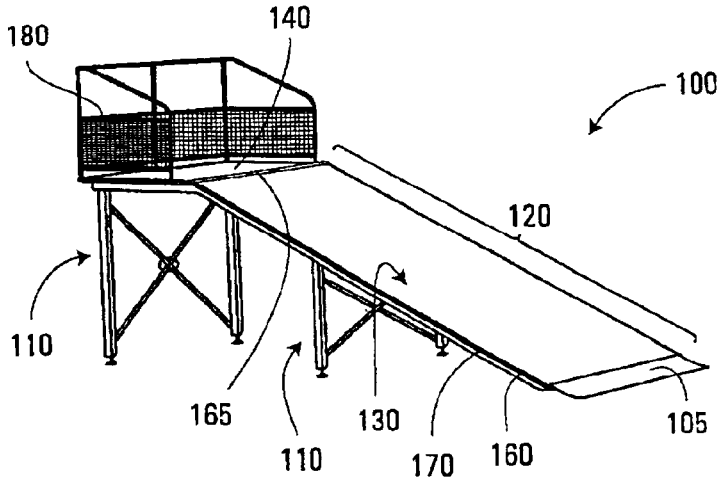
FIGS. 1A, 1B and 1C are perspective views of three example ramps in accordance with respective embodiments of the present invention.
Figure 1B:
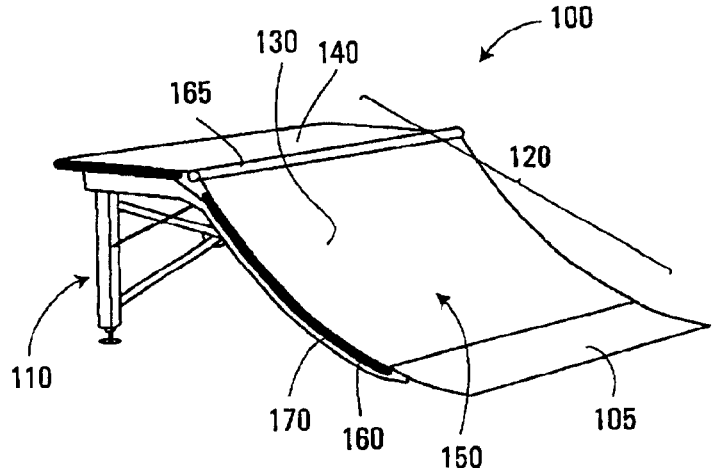
Figure 1C:
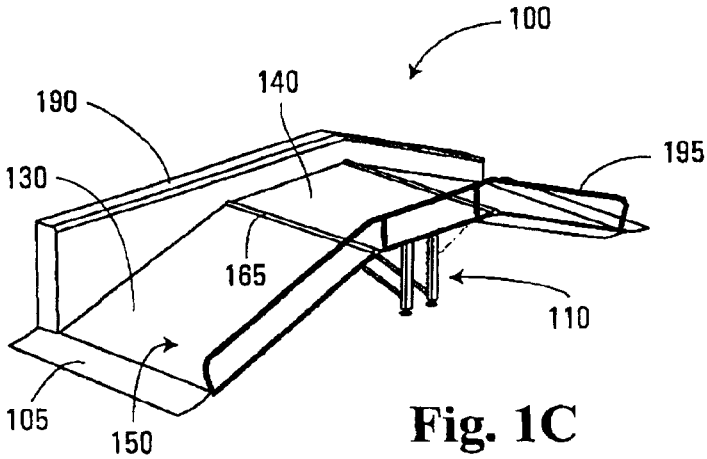

With reference to FIGS. 1A, 1B and 1C, there are shown three example embodiments of a recreational ramp 100 for use with wheeled vehicles such as skateboards, in-line skates, roller skates, roller-skis, bicycles (e.g., BMX), and so on. In each case, the ramp 100 includes a support structure 110 and a molded concrete layer 120 mounted on the support structure 110. The molded concrete layer 120 includes a sloping region 130 that extends from a ground level to an above-ground level. The molded concrete layer 120 also includes a platform 140 which acts as a braking surface. The dimensions of the platform 140 depend on the design parameters of the ramp 100, such as the elevation of the platform 140 with respect to the ground level.

The platform 140 may be integral with the sloping region 130. Alternatively, the platform 140 may be molded separately from the sloping region 130 and these two portions of the molded concrete layer 120 may be independently attached to the support structure 110 in a manner to be described later in further detail. A similar protective band 165 made of steel or other suitable material may protect a juncture 125 (best seen in FIG. 3) where the sloping region 130 and the platform 140 meet.

Likewise, an optional protective band 160 may surround a portion of the periphery 170 of the molded concrete layer 120. The protective band 160 may be made of steel treated against rust and may be affixed to the periphery 170 in any conventional way. A suitable thickness for the protective band is 1.5 inches, although other thicknesses are within the scope of the invention.

The sloping region 130 and the platform 140 can be said to define a top surface 150 of the molded concrete layer 120. Due to the texture of concrete, this top surface 150 is quiet when subjected to a rolling motion of wheeled vehicles such as skateboards. This makes the ramp 100 suitable for installation in residential areas. In addition, due to the fact that the concrete supported by the support structure 110 is in the form of a thin slab, the ramp 100 of the present invention will be considerably lighter in weight than conventional solid concrete ramps of the same size, and will not obstruct the field of view of a user proximate the ramp 100.

Moreover, by making the molded concrete layer 120 out of high-performance (high-compressive-strength) self-leveling concrete, it is possible to obtain a smoother and thinner surface than with traditional concrete, which is of particular advantage when vehicles with small wheels, such as skateboards, are used.

Additionally, as shown in FIG. 1A, a barrier 180 can surround the platform 140. The barrier 180 is not essential, although it may be advantageous, for example, in order to provide a sense of security to skateboarding enthusiasts who are coming out of a maneuver or waiting to use the ramp 100. The barrier 180 may take the form of a solid wall or, as illustrated in FIG. 1A, the barrier 180 may take the form of a grille, which has the advantage of being less dense, and thus lighter, than a solid wall.

Also, in some designs, the ramp 100 may include various additional features, such as boxes (see box 190 in FIG. 1C), islands, gaps, rails (see rail 195 in FIG. 1C), and so on. Such features are fastenable to the molded concrete layer and/or to the support structure 110 in any known way.

In some embodiments of the ramp 100, such as the one shown in FIG. 1A, the sloping region 130 will present a straight surface (i.e., at a constant gradient), while in other embodiments, such as the one shown in FIG. 1B, the sloping region 130 will present a curved surface. When a curved surface is presented, the radius of curvature may be constant or variable. Several particularly popular ramp designs include sloping regions 130 with a constant radius of curvature, in which the curved surface presents an arc of substantially 90 degrees (known as a "quarter-pipe" and shown in FIG. 1B) or 180 degrees (known as a "half-pipe"). Alternatively, a half-pipe may be constructed by placing two quarter-pipes adjacent one another, with the ground-level portions of the respective sloping regions in contact with one another.

Figure 2:
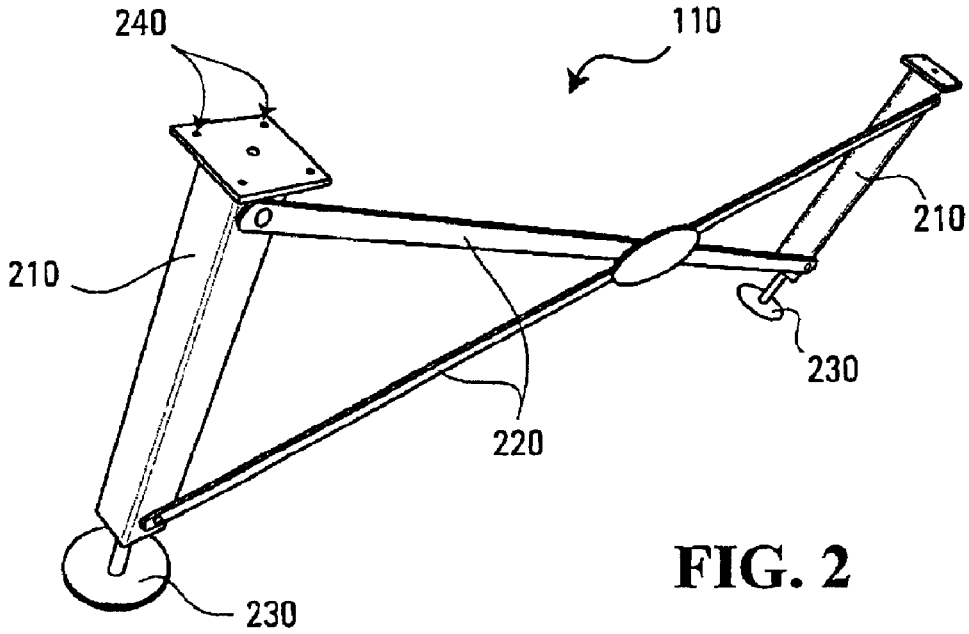
FIG. 2 is a perspective view of a support structure forming part of the ramp of FIG. 1A.

As shown in greater detail in FIG. 2, the support structure 110 may typically include an arrangement of vertical legs 210 and diagonal cross-braces 220 joining the legs 210. The legs 210 may have a rectangular tube-like structure with dimensions of three inches by three inches, although solid legs and legs having other dimensions are within the scope of the invention. The legs 210 have feet 230 which are adjustable in height. Such height adjustment may be achieved by providing multiple possible levels defined by buttons or by screwing the feet 230 in one direction to increase the leg height and in another to reduce the leg height. The adjustment of the feet 230 can also serve to level the support structure 110 where the ground on which it is placed is not level.

In a non-limiting example embodiment of the ramp 100 in FIG. 1A, known as a "six-foot bank", the length of the platform 140 is about four feet, the height of the platform 140 is about six feet, the length of the sloped region 130 of the ramp 100 is about fourteen to fifteen feet and the thickness of the molded concrete layer 120 varies between 1.5 and 6.5 inches. In a non-limiting example embodiment of the ramp 100 in FIG. 1B, known as a three-foot quarter pipe", the length of the platform 140 is about 30 inches, the height of the platform 140 is about three feet, the radius of curvature of the sloped region 130 is about six feet and the thickness of the molded concrete layer 120 varies between 1.5 and 6.5 inches. Other dimensions are of course possible, and the above examples merely serve to illustrate two of the myriad designs that will appeal to today's skateboard enthusiast and which are within the scope of the present invention.

The support structure 110 can be made of steel treated against rust (e.g., stainless or galvanized steel) or any other suitably rigid material that is resistant to corrosion. In order to attach the molded concrete layer 120 to the support structure 110, any suitable fastening mechanism can be used. For example, the legs may have holes 240 through which tamper-proof masonry fasteners can be inserted. An example of a suitable tamper-proof masonry fastener is the Torx® Tamper-Resistant TapCon® Concrete Screw available from Tanner Bolt & Nut Corp., Brooklyn, N.Y.

Because the molded concrete layer 120 has a finite thickness, the portion of the molded concrete layer 120 which meets the ground level would ordinarily present a step that is not always easy to overcome by a vehicle with small wheels, such as a skateboard. To this end, the portion of the molded concrete layer 120 at the ground level may be gradually thinned out so as to present a much smaller step to the user of the ramp. However, the reduction in thickness of the molded concrete layer 120 at an edge thereof increases the fragility of the layer 120 and may lead to erosion or damage of the concrete layer at its thinnest point around the periphery 170. Accordingly, a more desirable solution is to provide a transition plate 105 in order to bridge the step presented by the thickness of the molded concrete layer 120.

Thus, with continued reference to FIGS. 1A, 1B and 1C, the molded concrete layer 120 is recessed around a portion of its periphery 170. The depth of the recessed portion may be about ⅛ of an inch deep, although other depths are within the scope of the present invention, as long as the molded concrete layer 120 remains sufficiently thick in the recessed portion. The transition plate 105 is secured to the recessed portion of the molded concrete layer 120. The transition plate 105 could be secured to the recessed portion of the molded concrete layer 120 by any suitable masonry fastener or in any other suitable way known to those of ordinary skill in the art. The transition plate 105 may be made of neoprene, metal or plastic, although other materials are within the scope of the present invention.

In the most interior area of the recessed portion, the transition plate 105 has a thickness substantially equal to the thickness of the recess, so that there is a smooth transition between the top surface 150 of the molded concrete layer 120 and a top surface of the transition plate 105. The transition plate 105 can be curved so that there is also a smooth transition between the top surface of the transition plate 105 and the ground level. It should be noted that it is not necessary to affix the transition plate 105 to the ground, although to do so would not depart from the spirit of the present invention.

Figure 3:
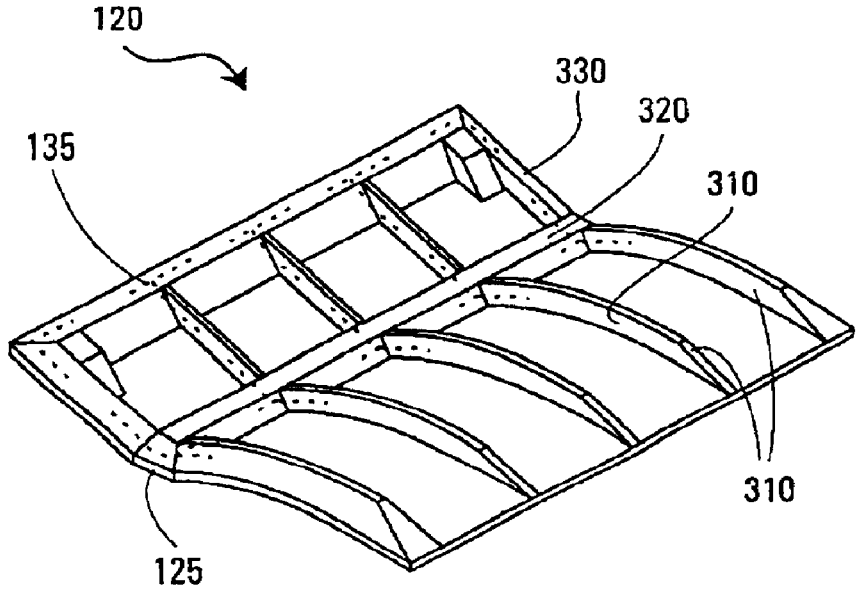
FIG. 3 is a perspective view of the underside of the molded concrete layer forming part of the ramp of FIG. 1B.

Reference is now made to FIG. 3 of the drawings, in which there is shown a perspective view of the underside of the molded concrete layer 120 in accordance with the embodiment shown in FIG. 1B. To provide additional support where necessary, an armature (shown in dotted outline at 135) may be provided within the molded concrete layer 120 around its periphery 170 and also through one or more cross-paths. In a non-limiting embodiment, the armature 135 may be composed of steel wires. Accordingly, the underside of the molded concrete layer 120 may include a plurality of ribs 310, 320 and a border 330 which occupy the volume in the neighbourhood of the armature 135.

The molded concrete layer 120 should have a thickness which allows sufficient rigidity to support the weight of multiple users as well as the pressure resulting from skateboard maneuvers. It has been found that a 1.5 inch thick molded concrete layer 120 with a thickness of 6.5 inches in the neighbourhood of the armature 135 and having a compressive strength of at least 40 MPa (Megapascals) provides a suitable degree of rigidity. Other combinations of thickness and compressive strength are of course within the scope of the invention. Generally speaking, higher compressive strength is preferred in order to afford an increased resistance to shock and allow for a reduction in thickness of the molded concrete layer 120.

One example of concrete having a suitable compressive strength and capable of being molded into a thin layer (on the order of a few inches) is self-leveling concrete. In particular, it has been found that a self-leveling concrete compound having a slump flow of at least 20 inches and a considerable degree of homogeneity is advantageous. Greater slump flow is preferred in order to afford a layer that fits the mold more accurately and has a smoother surface with fewer air pockets. However, it has been observed that too high a slump flow may lead to an inherent weakness in the compound once it solidifies. Therefore, if a self-leveling concrete is used, it is desirable although not essential that such concrete have a slump flow of between 20 and 28 inches.

Figure 4:
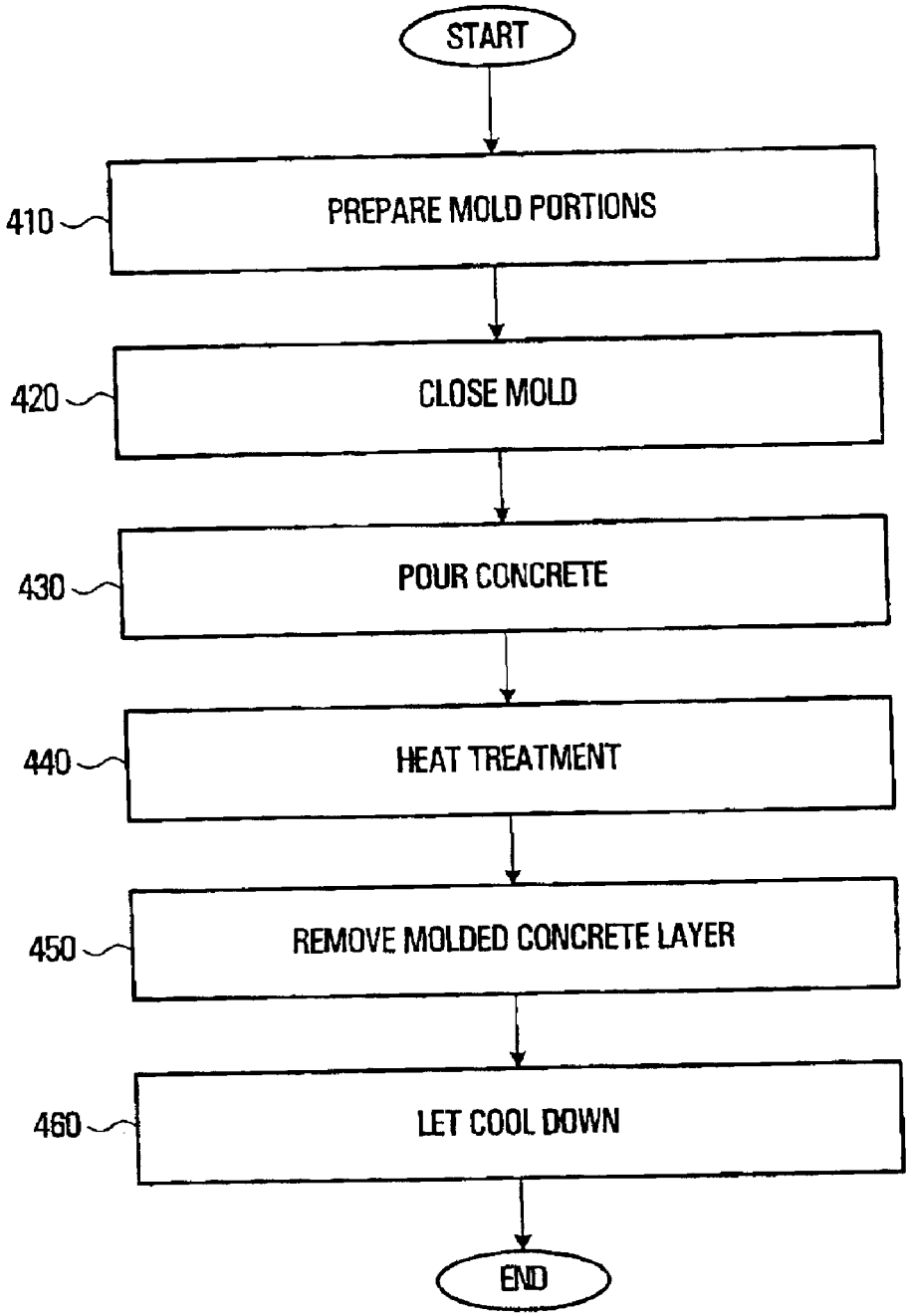
FIG. 4 is a flowchart showing an example sequence of steps in the process of manufacturing a ramp in accordance with an embodiment of the present invention.

A non-limiting example process for manufacturing the molded concrete layer 120 is now described with reference to FIG. 4. Specifically, a mold having several complementary parts is prepared at step 410. The mold is the negative of the intended shape of the molded concrete layer 120. Thus, of importance is the shape of the inside surface of each part of the mold. The inside surface of the mold can also be provided with recesses in the positions where it is desired to place the optional armature 135, around which will appear the reinforcement ribs 310/beams 320/border 330. To avoid the onset of rust, the armature 135 may undergo a pre-processing step, e.g., one which involves pre-coating the armature 135 with epoxy and bathing it in an electrolytic solution. At step 420, the complementary parts are closed onto one another, defining an interior space that has the desired shape of the concrete layer being manufactured.

A mixture of concrete is poured into the mold at step 430. Due to the relatively small amount of the space between the parts of the mold (providing a thickness of the ensuing concrete layer that ranges from about 1.5 inches to about 6.5 inches in an example embodiment), suitable rigidity is provided through the use of a high-performance concrete compound having a compressive strength of preferably at least 40 MPa (Megapascals) and, even more preferably, greater than 60 MPa. To this end, it is advantageous to use a self-leveling concrete compound, which typically exhibits a higher compressive strength than ordinary concrete for a given thickness. Also, the use of self-leveling concrete is advantageous because it will have a relatively high degree of fluidity compared to ordinary concrete, allowing it to enter various areas of the mold that occupy a space that is too small to accommodate a slurry of ordinary poured concrete. Moreover, self-leveling concrete has a tendency to produce a mirror-like surface having a desirable smoothness. A non-limiting example of a self-leveling concrete compound that is suitable for use with the present invention is Domflex™, which has been developed by Tessier Récréo-Parc Inc., Nicolet, Quebec, Canada.

Next, a curing period 440 ensues, during which the concrete settles and acquires a smoothness and a rigidity. During this phase the mold and its contents are heat-treated and kept at a high humidity level. A temperature of 60 degrees Celsius and a humidity level of greater than 90% have been found to be suitable, although other combinations are within the scope of the present invention. At step 450, the parts of the mold are removed and the remaining molded concrete layer 120 is allowed to cool down at step 460. At this point, the molded concrete layer 120 is ready to be mounted onto a support structure 110 using the fastening techniques described previously.

While specific embodiments of the present invention have been described and illustrated, it will be apparent to those skilled in the art that numerous modifications and variations can be made without departing from the scope of the invention as defined in the appended claims.

What is claimed is:

1. A recreational ramp suitable for use with wheeled vehicles, comprising:

a support structure;

a molded concrete layer including self-leveling concrete and mounted on said support structure, said molded concrete layer including a sloping region that extends from a ground level to an above-ground level;

wherein said molded concrete layer has a bottom surface and comprises reinforcement ribs disposed at intervals along said bottom surface of said molded concrete layer.

2. A recreational ramp as defined in claim 1, wherein said support structure comprises a plurality of legs, each said leg having a corresponding foot for contact with the ground level.

3. A recreational ramp as defined in claim 2, wherein each foot has a height that is adjustable.

4. A recreational ramp as defined in claim 2, wherein the height of each foot is adjustable by screwing or unscrewing said foot within the corresponding leg.

5. A recreational ramp as defined in claim 1, wherein said molded concrete layer defines a top surface that faces away from the ground, said ramp further comprising a transition plate joining said top surface of said molded concrete layer to the ground level.

6. A recreational ramp as defined in claim 5, wherein said molded concrete layer has a periphery that is recessed around a portion thereof to receive an edge of said transition plate.

7. A recreational ramp as defined in claim 5, wherein said transition plate is mounted to said molded concrete layer by a plurality of anchors.

8. A recreational ramp as defined in claim 7, wherein said transition plate is made of neoprene.

9. A recreational ramp as defined in claim 1, wherein said support structure is made of steel.

10. A recreational ramp as defined in claim 1, wherein said molded concrete layer is attached to said support structure by masonry fasteners.

11. A recreational ramp as defined in claim 10, wherein said masonry fasteners are tamper-proof masonry fasteners.

12. A recreational ramp as defined in claim 1, wherein said molded concrete layer has a thickness between about 1.5 inches and about 6.5 inches.

13. A recreational ramp as defined in claim 1, further comprising an armature embedded in the molded concrete layer.

14. A recreational ramp as defined in claim 13, wherein said reinforcement ribs surround said armature.

15. A recreational ramp as defined in claim 1, wherein said molded concrete layer has a thickness of about 1.5 inches in an area devoid of reinforcement ribs and about 6.5 inches in an area containing a reinforcement rib.

16. A recreational ramp as defined in claim 1, said molded concrete layer further including a platform at the above-ground level, said molded concrete layer further having a peripheral edge; and a protective band surrounding a portion of said peripheral edge of said molded concrete layer.

17. A recreational ramp as defined in claim 16, said protective band surrounds a portion of said peripheral edge of said molded concrete layer in a vicinity of said sloping region.

18. A recreational ramp as defined in claim 16, said protective band being made of steel.

19. A recreational ramp as defined in claim 1, said molded concrete layer further including a platform at the above-ground level; and a barrier surrounding a portion of said platform.

20. A recreational ramp as defined in claim 19, wherein said barrier is attached to said platform.

21. A recreational ramp as defined in claim 19, wherein said barrier is attached to said support structure.

22. A recreational ramp as defined in claim 19, wherein said barrier includes a grille.

23. A recreational ramp as defined in claim 1, wherein said sloping region presents a curved top surface facing away from the ground.

24. A recreational ramp as defined in claim 23, wherein said curved surface has a substantially constant radius of curvature.

25. A recreational ramp as defined in claim 24, wherein said curved surface presents an arc of about 90 degrees.

26. A recreational ramp as defined in claim 24, wherein said curved surface presents an arc of about 180 degrees.

* * * * *